US008422914B2

(12) United States Patent
Hayashi et al.

(10) Patent No.: US 8,422,914 B2
(45) Date of Patent: Apr. 16, 2013

(54) DEVELOPING CARTRIDGE

(75) Inventors: Naoki Hayashi, Mishima (JP); Takahito Ueno, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 288 days.

(21) Appl. No.: 12/906,529

(22) Filed: Oct. 18, 2010

(65) Prior Publication Data

US 2011/0103832 A1 May 5, 2011

(30) Foreign Application Priority Data

Oct. 30, 2009 (JP) ..... 2009-249749

(51) Int. Cl.
*G03G 15/08* (2006.01)

(52) U.S. Cl.
USPC ..... 399/119

(58) Field of Classification Search ..... 399/111, 399/119, 110, 107
See application file for complete search history.

(56) References Cited

U.S. PATENT DOCUMENTS

| | | | | |
|---|---|---|---|---|
| 4,839,691 | A * | 6/1989 | Tagawa et al. | 399/119 |
| 6,385,416 | B1 | 5/2002 | Horikawa et al. | |
| 6,608,980 | B2 | 8/2003 | Murayama et al. | |
| 6,714,752 | B2 | 3/2004 | Ueno et al. | |
| 6,785,499 | B1 * | 8/2004 | Tanaka | 399/119 |
| 6,823,153 | B2 | 11/2004 | Ueno et al. | |
| 6,829,455 | B2 | 12/2004 | Yasumoto et al. | |
| 6,834,175 | B2 | 12/2004 | Murayama et al. | |
| 6,898,391 | B2 | 5/2005 | Numagami et al. | |
| 6,912,365 | B2 | 6/2005 | Ueno et al. | |
| 6,954,600 | B2 | 10/2005 | Fujita et al. | |
| 6,954,601 | B2 | 10/2005 | Numagami et al. | |
| 6,968,146 | B1 | 11/2005 | Fujita et al. | |
| 6,970,668 | B2 | 11/2005 | Ueno et al. | |
| 6,978,099 | B2 | 12/2005 | Ueno et al. | |
| 7,003,247 | B2 | 2/2006 | Koishi et al. | |
| 7,062,200 | B2 | 6/2006 | Ueno et al. | |
| 7,092,658 | B2 | 8/2006 | Yasumoto et al. | |
| 7,139,502 | B2 | 11/2006 | Koishi et al. | |
| 7,158,749 | B2 | 1/2007 | Ueno et al. | |
| 7,164,875 | B2 | 1/2007 | Miyabe et al. | |
| 7,174,122 | B2 | 2/2007 | Fujita et al. | |
| 7,184,690 | B2 | 2/2007 | Ueno et al. | |
| 7,209,682 | B2 | 4/2007 | Numagami et al. | |
| 7,248,810 | B2 | 7/2007 | Miyabe et al. | |

(Continued)

FOREIGN PATENT DOCUMENTS

| | | | |
|---|---|---|---|
| JP | 2001-075458 | A | 3/2001 |
| JP | 3203242 | B2 | 6/2001 |
| JP | 2002278416 | A * | 9/2002 |

*Primary Examiner* — Susan Lee
(74) *Attorney, Agent, or Firm* — Fitzpatrick, Cella, Harper & Scinto

(57) ABSTRACT

A developing cartridge detachably mountable to a main assembly of an image forming apparatus includes: a frame; a developer carrying member for carrying a developer; a regulating member for regulating a layer thickness of the developer carried on the developer carrying member; a supporting member provided on the frame in a state in which the supporting member supports an end of the regulating member at a first end portion thereof; a grip portion, provided with a spacing from a second end portion of the supporting member opposite from the first end portion of the supporting member, for gripping the developing cartridge; and a sheet member, provided on the supporting member so as to extend from the second end portion toward the grip portion, for covering the second end portion by being bent by an operation for gripping the grip portion.

5 Claims, 11 Drawing Sheets

U.S. PATENT DOCUMENTS

| | | | |
|---|---|---|---|
| 7,315,710 | B2 | 1/2008 | Ueno et al. |
| 7,366,452 | B2 | 4/2008 | Fujita et al. |
| 7,440,715 | B2 | 10/2008 | Numagami et al. |
| 7,450,877 | B2 | 11/2008 | Miyabe et al. |
| 7,457,566 | B2 | 11/2008 | Koishi et al. |
| 7,483,646 | B2 | 1/2009 | Ueno et al. |
| 7,630,665 | B2 | 12/2009 | Ueno et al. |
| 7,702,251 | B2 | 4/2010 | Miyabe et al. |
| 7,720,408 | B2 | 5/2010 | Ueno et al. |
| 7,813,668 | B2 | 10/2010 | Ueno et al. |
| 2008/0152388 | A1 | 6/2008 | Ueno et al. |
| 2008/0260428 | A1 | 10/2008 | Ueno et al. |
| 2008/0286000 | A1 | 11/2008 | Kimizuka et al. |
| 2009/0317134 | A1 | 12/2009 | Miyabe et al. |
| 2009/0317135 | A1 | 12/2009 | Miyabe et al. |
| 2010/0054796 | A1 | 3/2010 | Nakamura et al. |
| 2010/0054804 | A1 | 3/2010 | Uneme et al. |
| 2010/0054805 | A1 | 3/2010 | Numata et al. |
| 2010/0054806 | A1 | 3/2010 | Ueno et al. |
| 2010/0054823 | A1 | 3/2010 | Takasaka et al. |
| 2010/0158556 | A1 | 6/2010 | Miyabe et al. |
| 2011/0044717 | A1 | 2/2011 | Miyabe et al. |

* cited by examiner (a)

(b)

(a)

(b)

(a)

(b)

DEVELOPING CARTRIDGE

FIELD OF THE INVENTION AND RELATED ART

The present invention relates to a developing cartridge detachably mountable to an image forming apparatus.

Here, the image forming apparatus forms an image on a recording material (medium) by using an electrophotographic image forming process. For example, the image forming apparatus includes an electrophotographic copying machine, an electrophotographic printer (such as an LED printer or a laser beam printer), an electrophotographic facsimile machine, an electrophotographic word processor, and the like.

The developing cartridge integrally holds, as process means actable on an electrophotographic photosensitive member, at least a developing means and is to be mounted into and demounted from a main assembly of the electrophotographic image forming apparatus.

Further, the developing cartridge can be mounted into and demounted from the apparatus main assembly by a user himself (herself). Therefore, maintenance of the apparatus can be performed by the user without relying on a service person. As a result, a maintenance operation of the image forming apparatus is improved.

In recent years, the electrophotographic image forming apparatus has been required to be further downsized. Here, a so-called rotary type color electrophotographic image forming apparatus including a rotary, in which a plurality of developing cartridges is mountable, as one of means for downsizing the main assembly has been described in Japanese Patent No. 3203242.

Further, such a constitution that the mounting and demounting of each developing cartridge in a color image forming apparatus in which four developing cartridges for four colors are detachably accommodated in a rotary is performed by holding a grip portion of the developing cartridge, opening a cover provided on an upper surface, and mounting the developing cartridge from above or demounting the developing cartridge upward, has been described in Japanese Laid-Open Patent Application (JP-A) 2001-75458.

The recent electrophotographic image forming apparatus has been required to possess high speed and high image quality and at the same time has been required to be further downsized. For that purpose, there is need to downsize the cartridge which occupies a large space within the electrophotographic image forming apparatus.

In order to downsize the developing cartridge, it is required that constituent parts are downsized, the number of parts is reduced, and the respective parts are efficiently disposed. Further, the parts are disposed adjacent to each other and therefore, there is a possibility that when the user grips a grip portion during a mounting and demounting operation of the developing cartridge, the user touches another part with his (her) finger to cause deterioration in usability.

SUMMARY OF THE INVENTION

The present invention has been accomplished in view of the above-described problems.

A principal object of the present invention is to provide a developing cartridge capable of realizing downsizing thereof without impairing usability.

According to an aspect of the present invention, there is provided a developing cartridge detachably mountable to a main assembly of an image forming apparatus, the developing cartridge comprising:

a frame;

a developer carrying member for carrying a developer;

a regulating member for regulating a layer thickness of the developer carried on the developer carrying member;

a supporting member provided on the frame in a state in which the supporting member supports an end of the regulating member at a first end portion thereof;

a grip portion, provided with a spacing from a second end portion of the supporting member opposite from the first end portion of the supporting member, for gripping the developing cartridge; and a sheet member, provided on the supporting member so as to extend from the second end portion toward the grip portion, for covering the second end portion by being bent by an operation for gripping the grip portion.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

As one form for carrying out the present invention, embodiments of a so-called rotary type color electrophotographic image forming apparatus including a rotary in which a plurality of developing cartridges is mountable will be described with reference to the drawings.

First Embodiment

General Structure of Color Electrophotographic Image Forming Apparatus

First, a constitution and an image forming operation of the color electrophotographic image forming apparatus in which the developing cartridges are mounted and an image is formed will be described.

Figure 1:
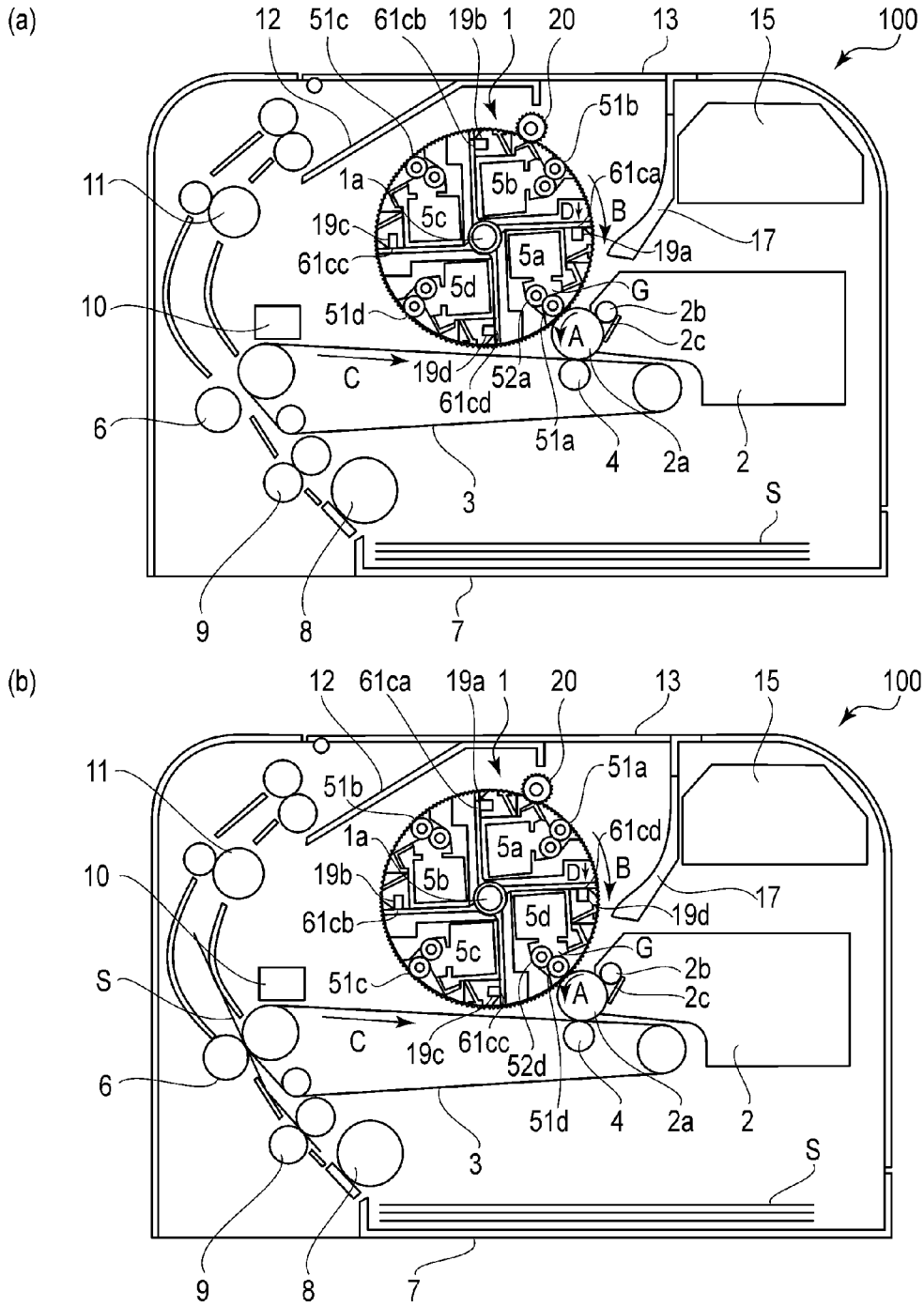
FIGS. 1(*a*) and 1(*b*) are schematic sectional views showing an example of an image forming apparatus main assembly during development in an embodiment of the present invention.

The color electrophotographic image forming apparatus in this embodiment of the present invention is a four color-based full-color laser beam printer. FIG. 1(*a*) is a sectional view showing a schematic structure of the image forming apparatus during a developing operation of a yellow developing cartridge 5*a*. FIG. 1(*b*) is a sectional view showing a schematic structure of the image forming apparatus during the developing operation of a black developing cartridge 5*d*.

As shown in FIG. 1(*a*), a main assembly of an image forming apparatus 100 includes a photosensitive drum 2*a*. At a periphery of the photosensitive drum 2*a*, a charging means 2*b* (charging roller in this embodiment) for uniformly charging the photosensitive drum 2*a* and an exposure means 15 for forming a latent image on the photosensitive drum 2*a* by irradiating the surface of the photosensitive drum 3*a* with laser light are disposed. Further, the main assembly of the image forming apparatus 100 includes a plurality of developing cartridges 5 (5*a* to 5*d*) each for developing the latent image formed on the photosensitive drum 2*a* with toner of an associated color. The plurality of developing cartridges 5 refers to a yellow developing device 5*a*, a magenta developing device 5*b*, a cyan developing device 5*c* and a black developing device 5*d*. Further, a cleaning means 2*c* for removing residual toner on the photosensitive drum 2*a* is disposed.

In this embodiment, the photosensitive drum 2*a*, the charging means 2*b* and the cleaning means 2*c* are integrally constituted and are assembled into a drum cartridge 2, which is detachably mountable to the image forming apparatus 100 and is employed.

A rotary 1 is constituted rotatably about a rotational axis (rotation shaft) 1*a* and holds the yellow developing cartridge 5*a*, the magenta developing cartridge 5*b*, the cyan developing cartridge 5*c* and the black developing cartridge 5*d* in the same attitude. The rotary 1 has the same developing cartridge holding constitution with respect to all the developing cartridges 5*a* to 5*d*.

When the developing cartridges 5 are mounted in the rotary 1, portions to be locked 61*c* (61*ca* to 61*cd*) engage with developing cartridge locking members 19 (19*a* to 19*d*) provided in the rotary 1. Each of the locking members 19 is urged by a spring (not shown) in a direction (indicated by an arrow D) in which the locking member 19 engages with the developing cartridge 5. As a result, detachment of the developing cartridge 5 from the rotary 1 is suppressed.

Here, the rotary 1 is attached to a main assembly frame in a state in which the rotary 1 holds the developing cartridges 5. In this embodiment, the developing cartridges 5 are mountable into and demountable from the rotary 1 with respect to a radial direction of the rotary 1.

During image formation, the photosensitive drum 2*a* is rotated in a counterclockwise direction indicated by an arrow A in FIG. 1(*a*) in synchronism with rotation of an intermediary transfer belt 3 in a direction indicated by an arrow C in FIG. 1(*a*). Then, the surface of the photosensitive drum 2*a* is uniformly charged by the charging means 2*b* and at the same time is irradiated with light for a yellow image by the exposure means 15, so that an electrostatic latent image for yellow is formed on the photosensitive drum 2*a*.

In synchronism with this formation of the electrostatic latent image, the rotary 1 is rotated about a rotary rotational axis (rotation shaft) 1*a* in the clockwise direction indicated by an arrow B in FIG. 1(*a*) by a drive transmission mechanism provided in the image forming apparatus 100. By the rotation of the rotary 1, the yellow developing cartridge 5*a* is disposed at a developing position in which the yellow developing cartridge 5*a* opposes the photosensitive drum 2*a* (FIG. 1(*a*)), Then, a voltage of an identical polarity to a charge polarity of the photosensitive drum 2*a* is applied to a developing roller 51*a* so that a yellow developer is deposited on the latent image formed on the photosensitive drum 2*a*. As a result, the latent image formed on the photosensitive drum 2*a* is developed by depositing the yellow developer thereon. That is, a yellow developer image is formed on the photosensitive drum 2*a*.

Thereafter, by applying a voltage of an opposite polarity to the toner charge polarity to a primary transfer roller 4 disposed inside the intermediary transfer belt 3, the yellow toner image is primary-transferred from the photosensitive drum 2*a* on to the intermediary transfer belt 3.

In the above-described manner, when the primary transfer of the yellow toner image is completed, the rotary 1 is rotationally moved in the arrow B direction in FIG. 1(*a*) by receiving a driving force from the drive transmission mechanism of the image forming apparatus 100. Then, the magenta developing cartridge 5*b*, the cyan developing cartridge 5*c* and the black developing cartridge 5*d* are successively positioned at the developing position in which the positioned developing cartridge opposes the photosensitive drum 2*a*.

Similarly as in the case of yellow, with respect to each of the colors of magenta, cyan and black, the formation of the electrostatic latent image, the development of the electrostatic latent image and the primary transfer are successively performed, so that four color toner images are superposed on the intermediary transfer belt 3.

During this image forming operation, as shown in FIG. 1(*a*), a secondary transfer roller 6 is in non-contact with the intermediary transfer belt 3. Further, at that time, a cleaning unit 10 for the intermediary transfer belt 3 is also in non-contact with the intermediary transfer belt 3.

On the other hand, sheets S which are a recording material (medium) for the toner images are stacked and accommodated in a sheet feeding cassette 7 provided at a lower portion of the image forming apparatus 100 and are separated and fed one by one from the sheet feeding cassette 7 by a sheet feeding roller 8, thus being fed to a registration roller pair 9. The registration roller pair 9 sends the fed sheet S between the intermediary transfer belt 3 and the secondary transfer roller 6. Here, as shown in FIG. 1(*b*), the secondary transfer roller 6 is in a state in which it press-contacts the intermediary transfer belt 3.

Further, the voltage of the opposite polarity to the toner charge polarity has been applied to the secondary transfer roller 6, so that the above-described four color toner images superposed on the intermediary transfer belt 3 are collectively secondary-transferred onto the surface of the conveyed sheet S.

The sheet S on which the toner images are transferred is sent to a fixing device 11. In the fixing device 11, the sheet S is heated and pressed, so that the toner images are fixed on the sheet S. As a result, an image is formed on the sheet Sm and then the sheet S is discharged from the fixing device 11 to a sheet discharge portion of an upper cover 12 of the image forming apparatus 100.

(Developing Cartridge Constitution)

Next, the developing cartridges 5 will be described. With respect to the developing cartridges 5, all the constitutions of the yellow developing cartridge 5*a*, the magenta developing cartridge 5*b*, the cyan developing cartridge 5*c* and the black developing cartridge 5*d* are the same. Therefore, the description of the constitutions of the respective developing cartridges 5*a* and 5*d* will be made with respect to the developing cartridge 5. The developing cartridge 5 will be described with reference to FIGS. 2(*a*), 2(*b*) and 3.

Figure 2:
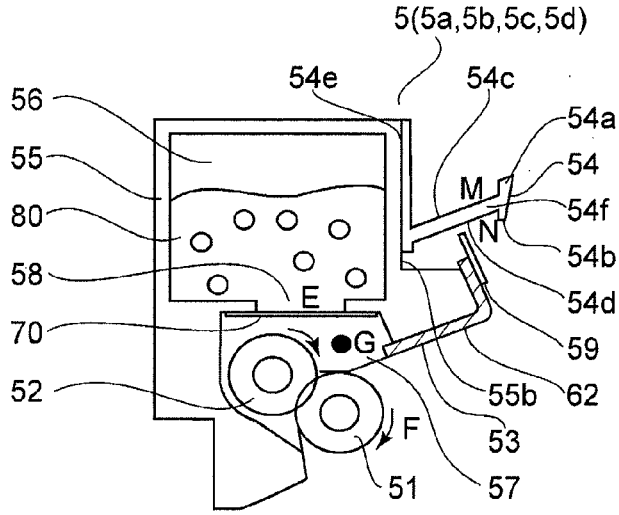
FIGS. 2(*a*) and 2(*b*) are schematic sectional views of a developing cartridge according to the embodiment of the present invention.
Figure 2:
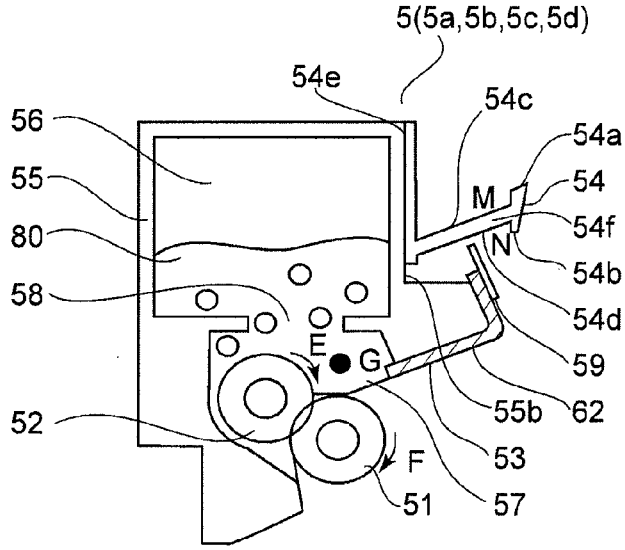
Figure 3:
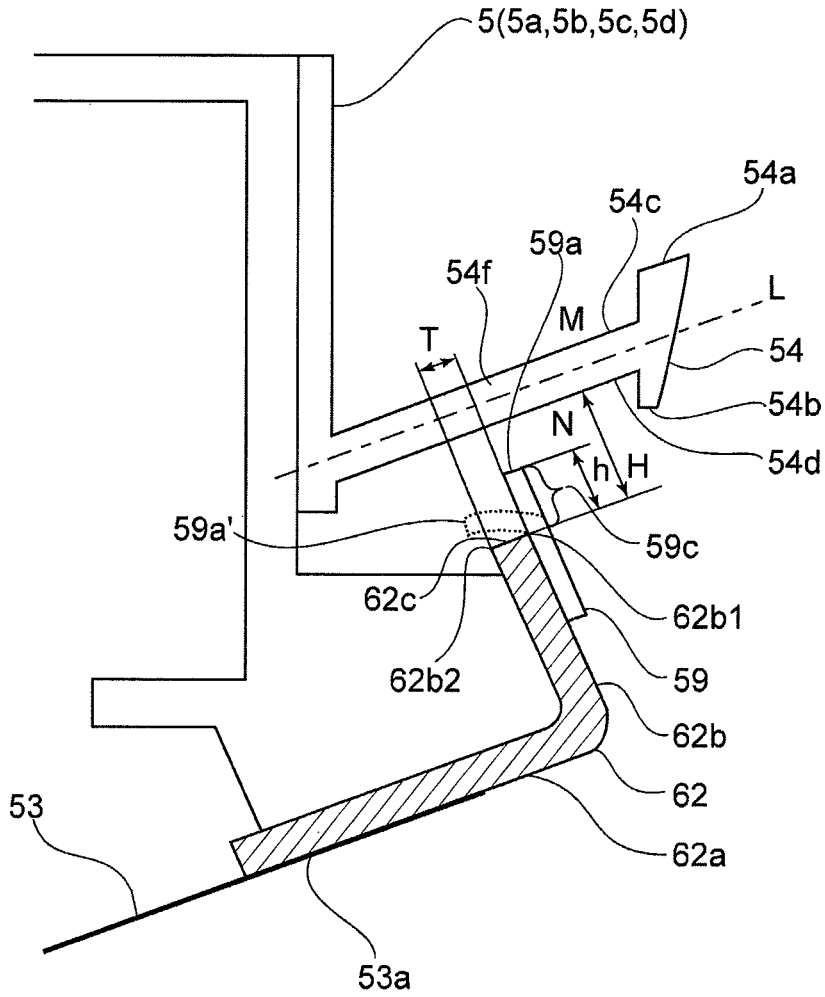
FIG. 3 is a schematic sectional view showing a grip portion of the developing cartridge according to the embodiment of the present invention.

FIG. 2(*a*) is a sectional view of the developing cartridge 5 in this embodiment before a toner seal is pulled out. FIG. 2(*b*) is a sectional view of the developing cartridge 5 in this embodiment after the toner seal is pulled out. FIG. 3 is an enlarged schematic sectional view of a grip portion 54 of the developing cartridge 5 and the neighborhood thereof in this embodiment.

A developing device (cartridge) frame 55 of the developing cartridge 5 is separated into a toner accommodating chamber 56 and a developing chamber 57 including a developing roller 51 and a toner feeding rotary 52. The both chambers 56 and 57 are vertically divided by a toner feeding opening 58.

In an unused state until the developing cartridge 5 is delivered to the user, as shown in FIG. 2(*a*), at the toner feeding opening 58, a film-like toner seal 70 for separating the toner accommodating chamber 56 and the developing chamber 57 is fixed. A fixing method may be welding or the like. By removing the toner seal 70 before use, toner 80 in the toner accommodating chamber 56 falls freely into the developing chamber 57 toward a developing position in which the developing cartridge 5 opposes the photosensitive drum as shown in FIG. 2(*b*).

The toner in the developing chamber 57 is fed to the toner feeding roller 52. Further, the toner feeding roller 52 feeds the toner to the developing roller 51 which is developer carrying member by rotating in a clockwise direction indicated by an arrow E. The developing roller 51 is constituted by an elastic rubber roller and rotates in a direction indicated by an arrow F. The toner on the surface of the developing roller 51 is regulated by a developing blade 52 so as to have a constant thickness and is subjected to development on the photosensitive drum 2*a* at the developing position.

The developing blade 53 is a regulating member for regulating a layer thickness of the developer carried on the surface of the developing roller 51 and contacts a circumferential support of the developing roller 51 with respect to an axial direction of the developing roller 51. Further, the developing blade 53 is, as shown in FIGS. 2(*a*) and 2(*b*), surfaced by a supporting member 62 on its one end side with respect to a widthwise direction (perpendicular to the axial direction of the developing roller 51). That is, as shown in FIG. 3, a surface 53*a* of the developing roller 53 contacts a surface 62*a* of the supporting member 62. One end portion of the supporting member 62, with respect to the widthwise direction of the supporting member 62, where the supporting member 62 surfaces the developing blade 53 is referred to as a first end portion. As a surfacing method, in this embodiment, YAG welding is employed but any connecting method may be used so long as the developing blade 53 can be firmly fixed. Further, in this embodiment, the supporting member 62 is formed with an about 1.2 mm-thick plate of a metal material, specifically of iron, SUS, or the like in order to ensure rigidity, and has a surface 62*b* which is bent at right angles to the surface 62*a* on a side opposite from a side where the developing blade 53 is surfaced. That is, the supporting member 62 has a bent portion which is bent in an L shape.

The supporting member 62 is, as shown in FIG. 2(*b*), fixed on the positioning device frame 55 so that the developing blade 52 contacts the developing roller 51 with a certain contact pressure and its longitudinal direction is parallel to an axis of the developing roller 51. That is, the supporting member 62 is attached to the developing device frame 55.

After the developing operation, the toner left on the surface of the developing roller 51 is removed by the toner feeding roller 51. Thereafter, the toner is fed again to the developing roller 51 by the toner feeding roller 52.

Further, at the developing position, in order to stably bring the developing roller 51 into contact with the photosensitive drum 2*a*, the developing roller 51 is urged together with the rotary 1 in a direction of the photosensitive drum 2*a*. As a result, the developing roller 51 of the developing cartridge 5 (the developing roller 51*a* of the yellow developing cartridge 5*a* in FIG. 1(*a*)) is in a state in which the developing roller 51 contacts the photosensitive drum 2*a* with a predetermined urging force.

At this time, the rotary 1 which holds the developing cartridge 5 is swingable about a rotary driving shaft (axis) 20 (FIG. 1(*a*)) and is urged as a whole in the direction of the photosensitive drum 2*a* by an urging means (not shown), so that the developing roller 51*a* contacts the photosensitive drum 2*a*.

(Grip Portion of Developing Cartridge)

Figure 4:
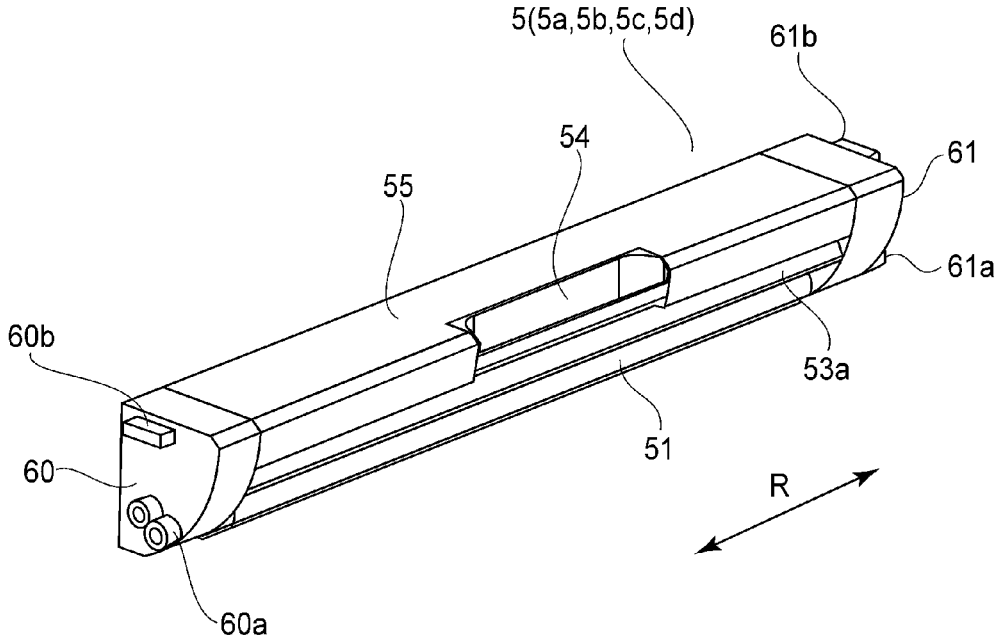
FIG. 4 is a perspective view showing an outer appearance of the developing cartridge according to the embodiment of the present invention.
Figure 5:
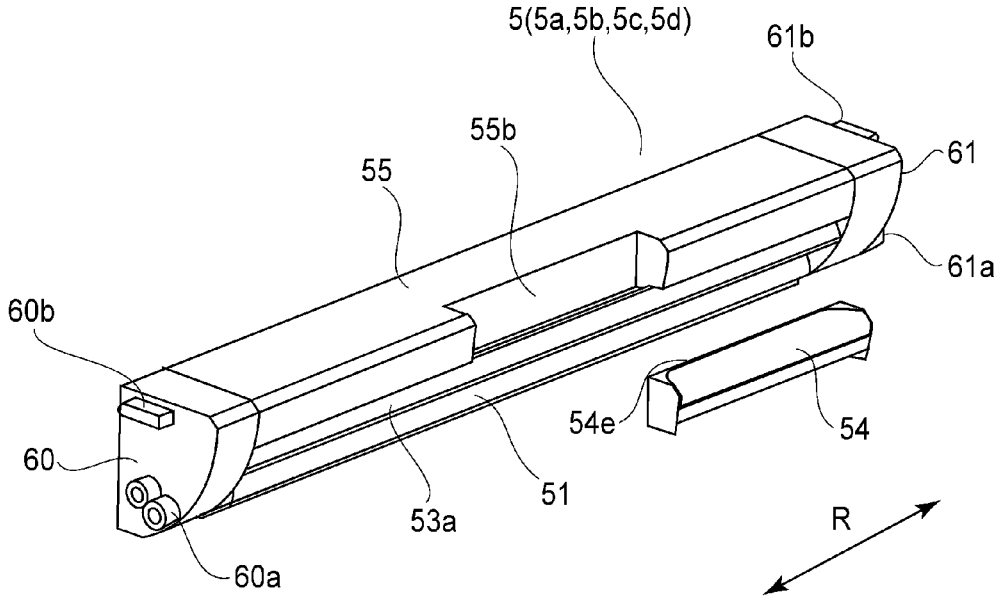
FIG. 5 is an exploded perspective view showing the grip portion of the developing cartridge according to the embodiment of the present invention.

Here, a constitution of the grip portion 54 of the developing cartridge 5 will be described with reference to FIGS. 2(*a*), 2(*b*), 3, 4 and 5. Incidentally, FIG. 4 is a schematic perspective view of the developing cartridge 5 in this embodiment. FIG. 5 is an exploded perspective view of the grip portion 54 of the developing cartridge 5.

The grip portion 54 is used for gripping (holding) the developing cartridge 5 and is positioned substantially at a central portion of the developing cartridge 5 with respect to the longitudinal direction (indicated by a double-pointed arrow R in FIG. 4) of the developing cartridge 5. Further, as shown in FIG. 3, a rib 54*f* having surfaces 54*c* and 54*d* is provided so as to oppose an end surface 62*c* of the supporting member 62 for surfacing the developing blade 53. That is, edge lines 62*b*1 and 62*b*2 which form the end surface 62*c* oppose the surface 54*d* of the grip portion 54. Further, at an end of the rib 54*c*, a projected portion 54*a* projected upward with respect to a rib center line L and a photosensitive drum 54*b* projected downward with respect to the rib center line L are provided. The projected portions 54*a* and 54*b* are projected by about 1 to 10 mm with respect to the surfaces 54*c* and 54*d*, respectively, and constitute a finger holding portion when the user grips the grip portion 54.

Further, the surfaces 54*c* and 54*d* are portions which are to be actually gripped by the user, and the developing cartridge 5 has a width of about 50 to 150 mm with respect to its longitudinal direction.

Referring to FIG. 2(*b*), into a space M above the surface 54*c* and a space N below the surface 54*d*, the user will put his (her) fingers. In this embodiment, it is optimum that the grip portion 54 is gripped by putting a forefinger, a middle finger and a ring finger into the space M and putting a thumb into the space N to hold the inclined surface portions 54*c* and 54*d*.

The grip portion 54 is fixed on the developing device frame 55 as a separate part. As shown in FIGS. 2(*a*), 2(*b*) and 5, a connection surface 54*e* of the grip portion 54 is fixed in a recessed portion 55*b* of the developing device frame 55. In this embodiment, the grip portion 54 is fixed by ultrasonic welding but the fixing method is not limited thereto and may also be those using an adhesive, a solvent, a double-sided adhesive tape, and the like.

Further, the grip portion 54 is, as shown in FIG. 3, provided with a gap H with respect to a bent portion-side end portion of the L-shaped supporting member 62, i.e., the other end side (second end portion) of the supporting member 62 opposite from one end side (first end portion) of the 62, where the supporting member 62 supports, with respect to the widthwise direction of the supporting member 62. Thus, by providing the gap H, the space N is increased and ensured.

(Mounting and Demounting of Developing Cartridge)

Next, the mounting and demounting operation of the developing cartridge 5 with respect to the image forming apparatus 100 will be described with reference to FIGS. 6(*a*), 6(*b*) and 7. Incidentally, all the mounting and demounting operations of the yellow developing cartridge 5*a*, the magenta developing cartridge 5*b*, the cyan developing cartridge 5*c* and the black developing cartridge 5*d* are the same. Here, the case where the yellow developing cartridge 5*a* is mounted and demounted will be described as an example.

Figure 6:
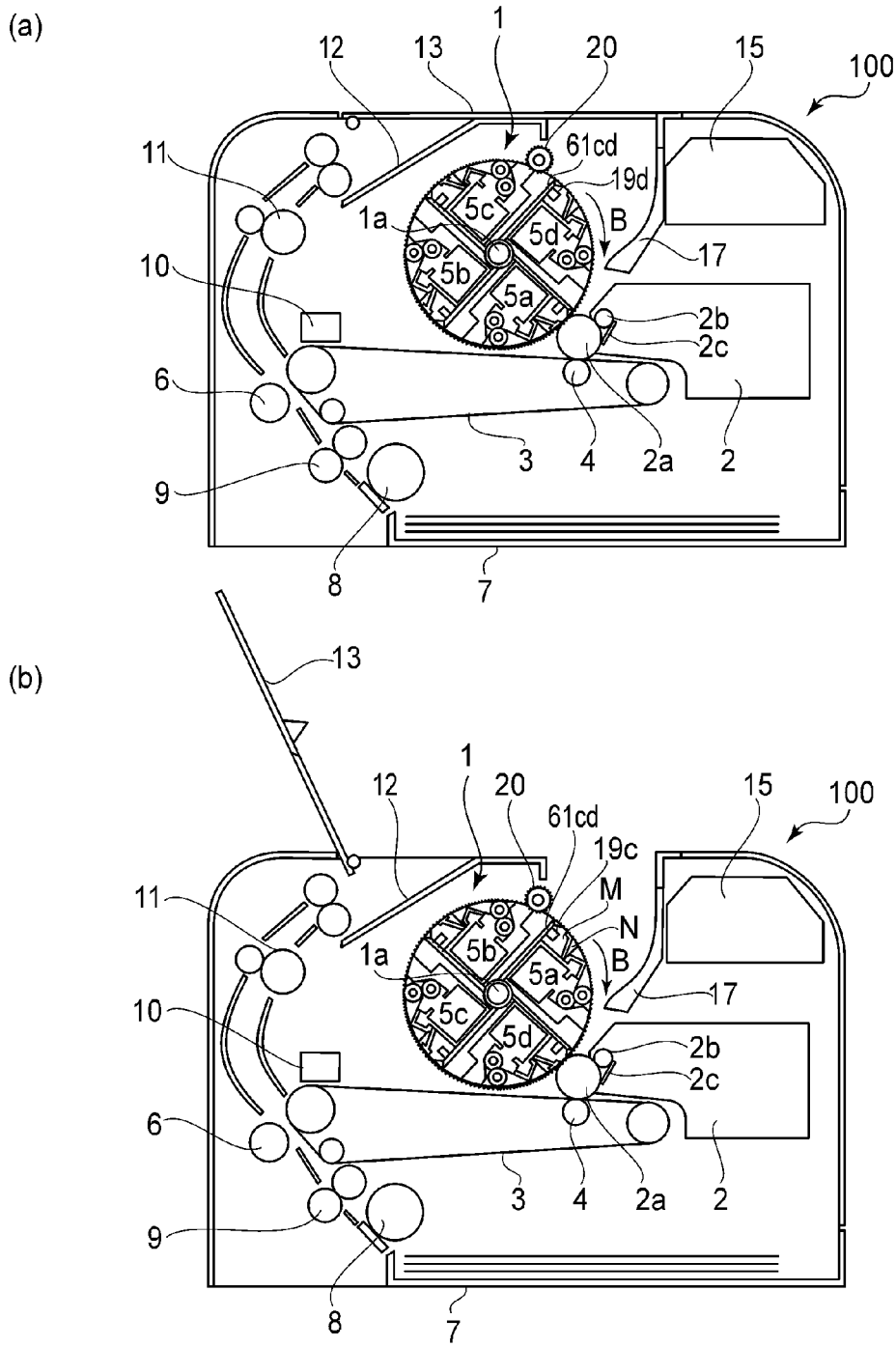
FIGS. 6(*a*) and 6(*b*) are schematic sectional views showing the image forming apparatus, in the embodiment of the present invention, placed in a stand-by state and a state in which the developing cartridge is mountable and demountable, respectively.
Figure 7:
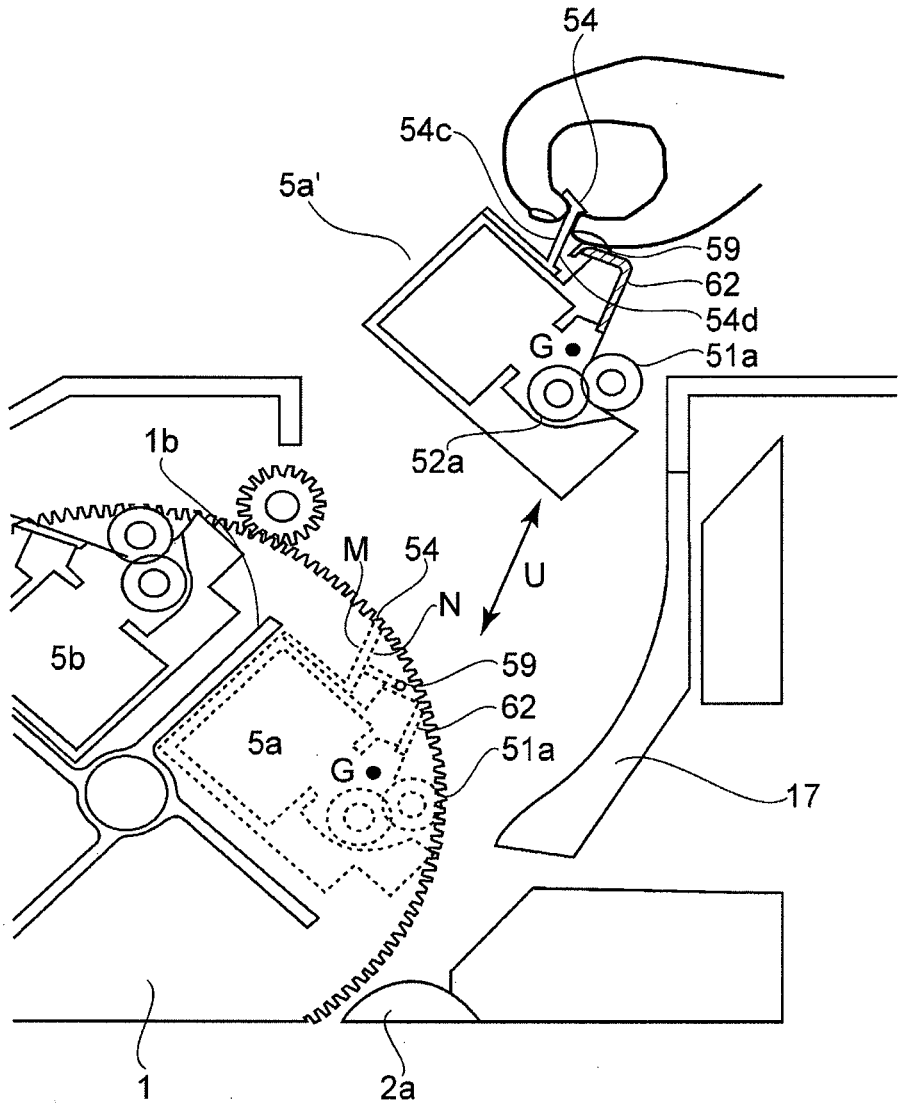
FIG. 7 is a schematic sectional view showing a mounting and demounting attitude of the developing cartridge according to the embodiment of the present invention.

FIG. 6(*a*) is a sectional view of the image forming apparatus main assembly in which the developing cartridges are in a stand-by state. FIG. 6(*b*) is a sectional view of the image forming apparatus main assembly in which the yellow developing cartridge 5*a* is located at a mounting and demounting position when it is mounted and demounted. FIG. 7 is a sectional view when the yellow developing cartridge 5*a* is mounted and demounted.

The rotary 1 is on stand-by in the stand-by state at a position in which the rotary 1 is rotated about the rotary rotation shaft 1*a* until a phase thereof reaches the phase in which the developing roller 51*a* is separated from the photosensitive drum 2*a*. In this embodiment, as shown in FIG. 6(*a*), the stand-by state is created at a position in which the black developing cartridge 5*d* is located about 45 degrees upstream from the developing position with respect to the rotary rotational direction B. Movement of the rotary 1 to the stand-by state (position) is automatically effected by the drive transmission mechanism after the completion of the developing operation.

Then, in order to take out the yellow developing cartridge 5*a* from the image forming apparatus 100, as shown in FIG. 6(*b*), a mounting and demounting cover 13 is opened, so that the user can mount and demount the yellow developing cartridge 5*a*.

That is, the user puts the forefinger, the middle finger and the ring finger into the space M and puts the thumb into the space N, so that the user can grips the grip portion 54 and then the user can take out the yellow developing cartridge 5*a*.

With respect to other cartridges, i.e., the magenta developing cartridge 5*b*, the cyan developing cartridge 5*c* and the black developing cartridge 5*d*, in a similar manner, the associated developing cartridge can be mounted and demounted at the position which is 45 degrees upstream from the developing position with respect to the rotary rotation direction B.

As shown in FIG. 7, when the user grips the grip portion 54, the attitude of the yellow developing cartridge 5*a* is substantially identical to that (indicated by a broken line) at the mounting and demounting position in the image forming apparatus 100. For this reason, an operation for mounting the yellow developing cartridge 5*a* into the image forming apparatus 100 and for demounting the yellow developing cartridge 5*a* from the image forming apparatus 100 is easily performed by the user. This is because at the mounting and demounting position, the grip portion 54 is located substantially vertically above the center of gravity G of the yellow developing cartridge 5*a*. The center of gravity G in this embodiment is located in the neighborhood of the developing roller 51*a*, the toner feeding roller 52*a* and the developing blade supporting member 62.

Figure 8:
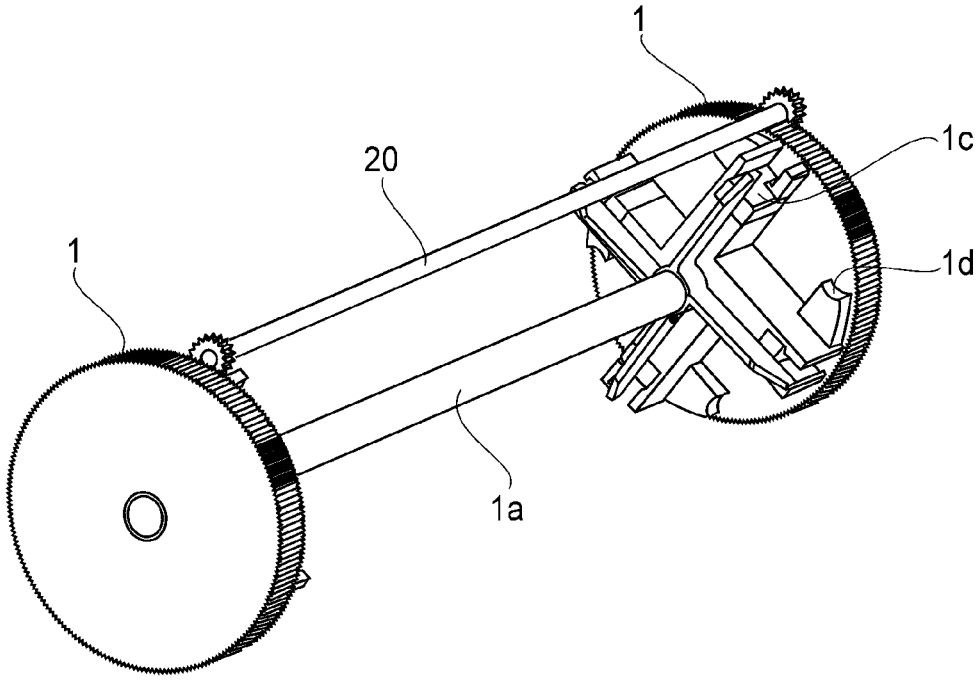
FIG. 8 is a schematic sectional view of a rotary for holding the developing cartridge according to the embodiment of the present invention.

Here, a mounting locus of the developing cartridge 5 will be described with reference to FIGS. 7 and 8. FIG. 8 is a schematic perspective view of the rotary for holding the developing cartridges.

As shown in FIG. 7, a developing cartridge 5*a*' is moved in a direction indicated by a double-pointed arrow U along a main assembly guide 17, thus being mounted into and demounted from the rotary 1. The developing cartridge 5*a*' is moved by guiding guide members 60*b* and 61*b* (FIG. 4), disposed don side members 60 and 61 fixed on both end portions of the developing roller 5*a* with respect to the axial direction of the developing roller 51*a*, to a predetermined position along a guide portion 1*c* of the rotary 1. Further, as shown in FIG. 8, the rotary 1 includes a positioning portion 1*d* for positioning the developing cartridge.

The developing cartridge 5 is positioned by abutting outer circumferential portions of axis portions 60*a* and 61*a*, of the side members 60 and 61 fixed on the both end portions of the developing cartridge 5 shown in FIGS. 4 and 5 with respect to the developing roller axial direction, against the positioning portion 1*d*. In this embodiment, the axis portions 60*a* and 61*a* are coaxially located with respect to the developing roller 51 but are not required to be particularly restricted.

(Flexible Sheet Member)

On the developing cartridge 5, a sheet member 59 which is projected from the end portion (second end portion) of the supporting member 62 opposing the grip portion 54 toward the grip portion 54 and has flexibility (hereinafter, referred to as a flexible member) is provided. As a result, the fingers of the user is prevented from directly contact the end portion (second end portion) of the supporting member 62 by bending of the flexible member 59 by the operation for gripping the grip portion 54 by the user to cover the end portion (second end portion) with the flexible member 59.

Figure 9:
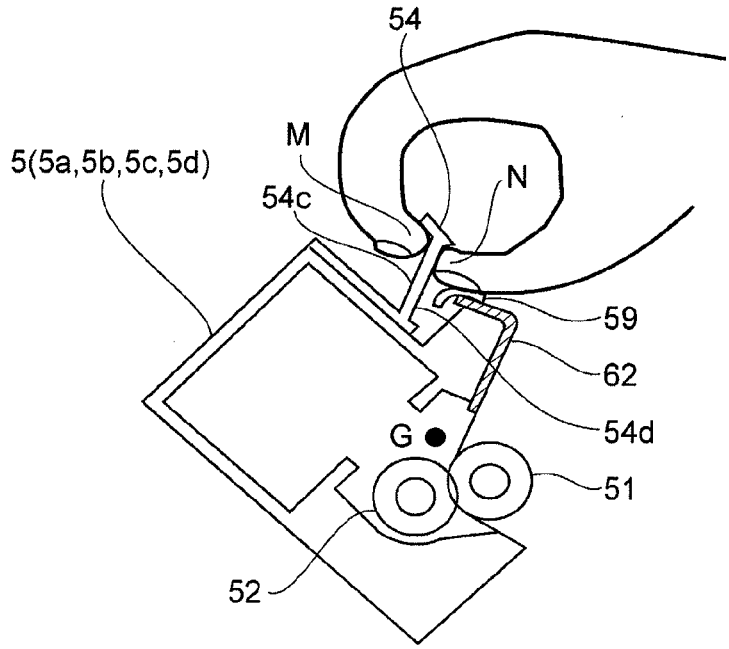
FIGS. 9(*a*) and 9(*b*) are enlarged schematic sectional views showing the grip portion of the developing cartridge according to the embodiment of the present invention.
Figure 9:
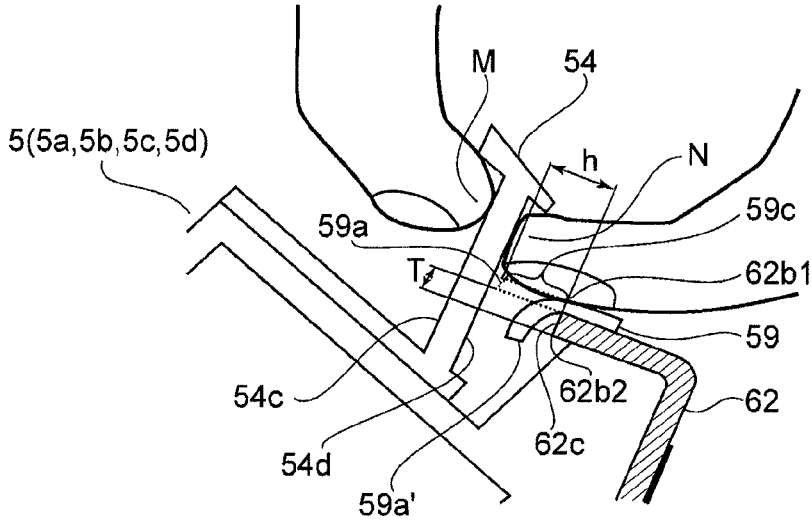

Next, the flexible member 59 will be described with reference to FIGS. 2(*b*), 3 and 9. Incidentally, FIG. 9(*a*) is a schematic sectional view showing a state in which the user grips the developing cartridge 5. FIG. 9(*b*) is an enlarged schematic sectional view showing the neighborhood of the grip portion 54 in the state in which the user grips the developing cartridge 5.

In this embodiment, the flexible member 59 is formed with a sheet-like material of polyethylene terephthalate, polyurethane, or the like and has a thickness of about 75 μm and a length, with respect to the axial direction of the developing roller 51, equal to that of the grip portion 54.

Further, as shown in FIG. 3, the flexible member 59 is projected so that its end surface 59*a* is projected from the surface 62*c* of the supporting member 62 for supporting the developing blade 53 so as to oppose the surface 54*d* of the grip portion 54. Further, a length h of a projected portion 59*c* of the flexible member 59 is set at a value which is not less than a thickness T of the supporting member 62 and which is not more than the gap H between the grip portion 54 and the supporting member end portion. Here, the projected portion 59*c* refers to a portion extending from the end portion edge line 62*b*1 of the supporting member 62 to the end surface 59*a* of the flexible member 59.

In the case where the length of the projected portion 59*c* is not less than the thickness T of the supporting member 62, the end surface 62*a* of the supporting member 62 is covered when the flexible member 59 is bent, so that the user's finger is prevented from contacting the supporting member 62. Incidentally, the length of the projected portion 59*c* may also be less than the thickness T of the supporting member 62 so long as the projected portion 59*c* can be interposed between the edge line 62*b*1 and the surface 54*d* of the grip portion 54.

The flexible member 59 is fixed on the surface 62*b* of the supporting member 62 with the double-sided adhesive tape but the fixing method is not necessarily limited thereto and may, e.g., be that using the adhesive or the like.

Further, as shown in FIGS. 9(*a*) and 9(*b*), in the case where the user grips the grip portion 54, when the thumb enters the space N, the thumb contacts the projected portion 59*c* of the flexible member 59, so that the end surface 59*a* of the flexible member 59 is bend to a position of an end surface 59*a*' indicated by a solid line. As a result, the photosensitive drum 59*c* is interposed position the surface 54*d* of the grip portion 54 and the edge lines 62*b*1 and 62*b*2 constituting the end surface 62*c* of the supporting member 62.

As a result, as described above, when the thumb of the user enters the space N for gripping the grip portion 54, a nail of the thumb is prevented from touching the end portion edge lines 62*b*1 and 62*b*2 of the supporting member 62 formed of the metal material, so that the user does not suffer discomfort. Further, because of the bending of the projected portion 59*c*, an area of the space N is not decreased and therefore a gripping property is not impaired.

Further, in the above embodiment, the length of the projected portion 59*c* was made longer than the thickness T of the supporting member 62 and the projected portion 59*c* was interposed between the surface 54*d* of the grip portion 54 and the end portion edge lines 62*b*1 and 62*b*2 of the supporting member 62. However, even when the length of the projected portion 59*c* is such that the projected portion 59*c* can be interposed between the surface 54*d* of the grip portion 54 and at least one edge line, a sufficient effect is achieved. Here, at least one edge line means the edge line (62*b*1 in FIG. 9(*b*)) closer to the end side of the grip portion 54.

Other Embodiments

In First Embodiment, the length of the flexible member 59 is longer than the thickness T of the supporting member 62 but is not limited thereto.

Figure 10:
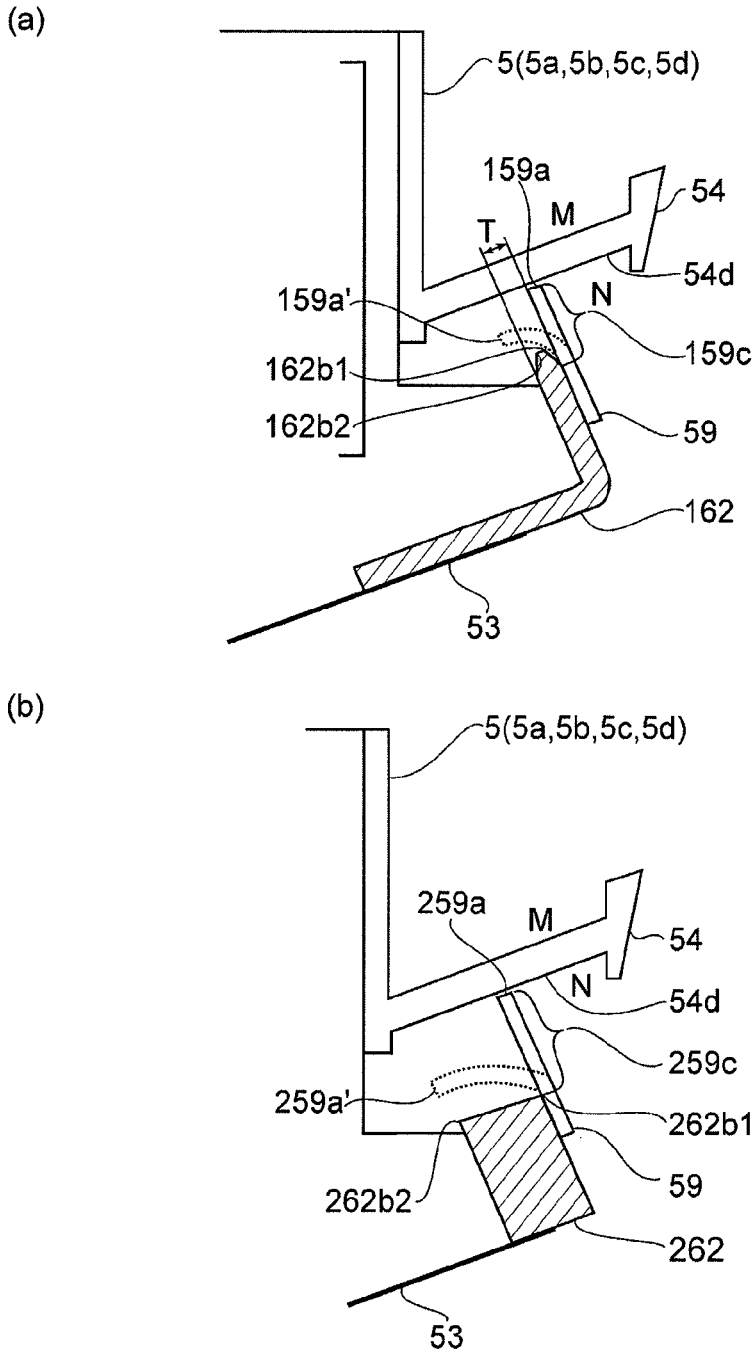
FIGS. 10(*a*), 10(*b*), 11(*a*), 11(*b*) and 12 are enlarged schematic sectional views showing grip portions of developing cartridges according to other embodiments of the present invention.

As a constitution of the supporting member, as shown in FIG. 10(*b*), the case where a plurality of surfaces constitutes a portion having a thickness T of a supporting member 162 can also be applicable. In this case, edge lines of the supporting member 162 which opposes the surface 54*d* of the grip portion 54 are 162*b*1 and 162*b*2. Further, the thumb of the user enters the space N, the thumb contacts a projected portion 159*c* of the flexible member 59, so that an end surface 159*a* of the flexible member 59 is bent to a position of an end surface 159*a*' indicated by a dotted line. Therefore, the length of the projected portion 159*c* may be such that the projected portion 159*c* can be interposed between the surface 54*d* of the grip portion 54 and the edge lines 162*b*1 and 162*b*2 of the supporting member 162.

In First Embodiment, the supporting member 62 for supporting the developing blade 53 was constituted by the metal plate since a part cost was low. However, the supporting member 62 may also be constituted by a squared material 262 in order to optimize the space is shown in FIG. 10(*b*). In this case, edge lines of the supporting member 162 which opposes the surface 54*d* of the grip portion 54 are 262*b*1 and 262*b*2. Further, the thumb of the user enters the space N, the thumb contacts a projected portion 259*c* of the flexible member 59, so that an end surface 259*a* of the flexible member 59 is bent to a position of an end surface 259*a*' indicated by a dotted line. Therefore, the length of the projected portion 259*c* may be such that the projected portion 159*c* can be interposed between the surface 54*d* of the grip portion 54 and the edge lines 262*b*1 and 262*b*2 of the supporting member 262.

Figure 11:
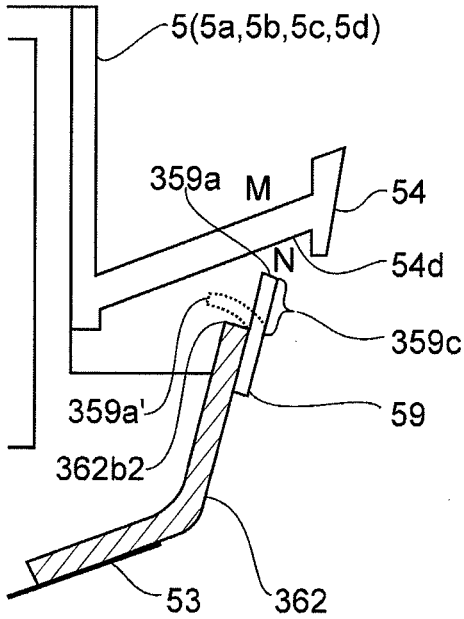
Figure 11:
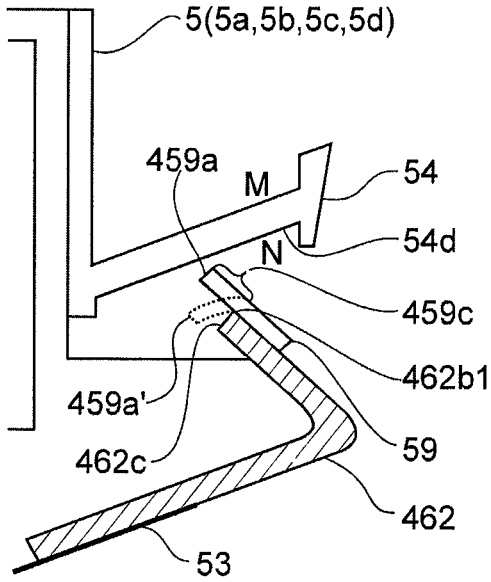
Figure 12:
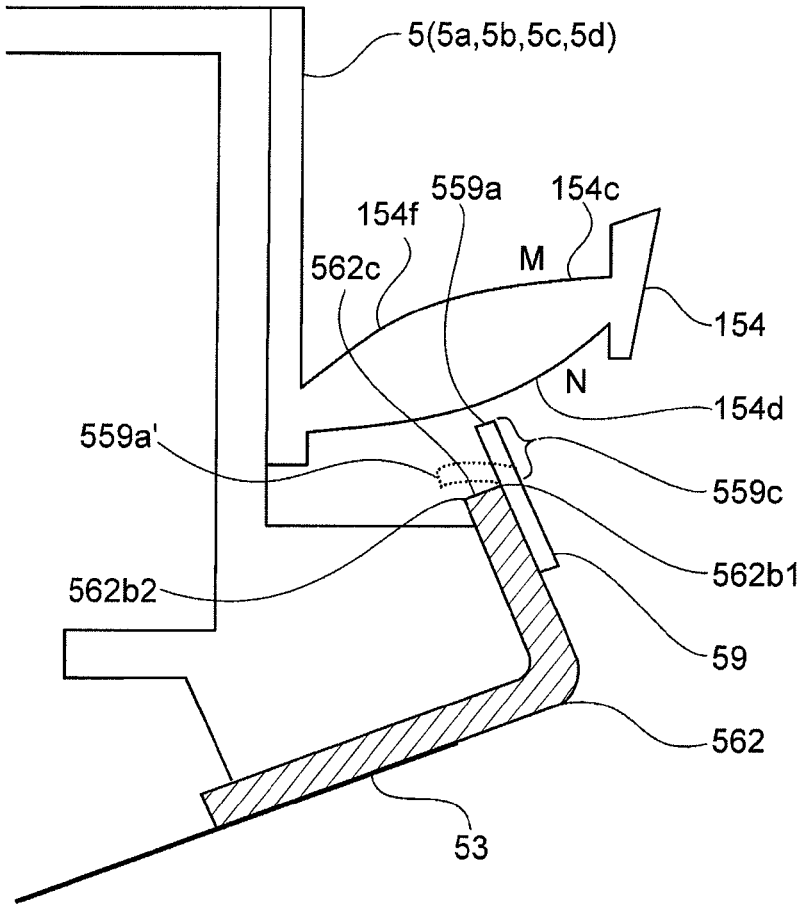

Further, the supporting member constitution in the present invention is also applicable to even the case where the supporting member is not perpendicular to the surface 54*d* of the grip portion 54 of the grip portion 54 as shown in FIGS. 11(*a*) and 11(*b*). In this case, edge lines of supporting members 362 and 462 opposing the surface 54*d* of the grip portion 54 are 362*b*2 and 462*b*1, respectively. Further, when the thumb of the user enters the space N, the thumb contacts each of projected portions 359*c* and 459*c* of the flexible members 59, so that each of end surfaces 359*a* and 459*a* of the flexible members 59 is bent to a position of an associated end surface 359*a*' or 459*a*'.

Therefore, as shown in FIG. 11(*b*), in the case where an end surface 362*c* of the supporting member 362 is directed toward the end of the rib 54*f* of the grip portion 54, i.e., in the case where a bending angle of the L-shaped supporting member 362 is an obtuse angle, the length of the projected portion 359*c* may be such that the projected portion 359*c* can be interposed between the edge line 362*b*2 and the surface 54*d* of the grip portion 54.

Further, as shown in FIG. 11(*b*), in the case where an end surface 462*c* of the supporting member 462 is directed toward the base of the rib 54*f* of the grip portion 54, i.e., in the case where a bending angle of the L-shaped supporting member 362 is an acute angle, the length of the projected portion 459*c* may be such that the projected portion 459*c* can be interposed between the edge line 462*b*1 and the surface 54*d* of the grip portion 54.

Further, in First Embodiment, the rib 54*f* of the grip portion is constituted by rectilinear surfaces but may also be constituted by curved surfaces 154*c* and 154*d*. In this case, edge lines of a supporting member 562 which opposes the curved surface 154*d* of a grip portion 154 are 562*b*1 and 562*b*2. Further, the thumb of the user enters the space N, the thumb contacts a projected portion 559*c* of the flexible member 59, so that an end surface 559*a* of the flexible member 59 is bent to a position of an end surface 559*a*' indicated by a dotted line. Therefore, the length of the projected portion 559*c* may be such that the projected portion 559*c* can be interposed between the curved surface 154*d* of the grip portion 154 and the edge lines 562*b*1 and 562*b*2 of the supporting member 562.

As described above, according to the developing cartridges according to the embodiments described above, the flexible member was disposed on the developing blade supporting member, and the length of the projected portion was such that the projected portion was deformed, when the user gripped the grip portion of the developing cartridge and was interposed between the grip portion and at least one edge line of the supporting member. As a result, the user can be prevented from touching the end portion edge line of the supporting member with the finger (thumb). Therefore, the grip portion and the supporting member can be disposed close to each other, so that the downsizing of the developing cartridge and an improvement in usability can be compatibly realized.

Incidentally, in the above-described embodiments, the case of the color developing cartridges used in the rotary type electrophotographic image forming apparatus is described. However, the present invention is not limited thereto but may also be applicable to those in the case where the image forming apparatus is of an in-line type and to a monochromatic developing cartridge.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 249749/2009 filed Oct. 30, 2009, which is hereby incorporated by reference.

What is claimed is:

1. A developing cartridge detachably mountable to a main assembly of an image forming apparatus, said developing cartridge comprising:

a frame;

a developer carrying member for carrying a developer;

a regulating member for regulating a layer thickness of the developer carried on said developer carrying member;

a supporting member provided on said frame in a state in which said supporting member supports an end of said regulating member at a first end portion thereof;

a grip portion, provided with a spacing from a second end portion of said supporting member opposite from the first end portion of said supporting member, for gripping said developing cartridge; and a sheet member, provided on said supporting member so as to extend from the second end portion toward said grip portion, for covering the second end portion by being bent by an operation for gripping said grip portion.

2. A cartridge according to claim 1, further comprising a bent portion between the first end portion and the second end portion.

3. A cartridge according to claim 1, wherein said supporting member is formed of a metal material.

4. A cartridge according to claim 1, wherein an amount of projection of said sheet member from the second portion is not less than a thickness of said supporting member.

5. A cartridge according to claim 1, wherein said sheet member is provided with a spacing from said grip portion at an end portion thereof on a side opposite from a side where said sheet member is provided on said supporting member.

* * * * *